United States Patent [19]

Snyder, Jr. et al.

[11] Patent Number: 4,493,777

[45] Date of Patent: Jan. 15, 1985

[54] WATER-BASED HYDRAULIC FLUIDS

[75] Inventors: Kenneth L. Snyder, Jr.; James Peters, both of Midland, Mich.

[73] Assignee: The Dow Chemical Company, Midland, Mich.

[21] Appl. No.: 451,132

[22] Filed: Dec. 20, 1982

[51] Int. Cl.[3] ..... C10M 3/04; C10M 3/12

[52] U.S. Cl. ..... 252/49.3; 252/49.5; 252/73; 252/79; 72/42

[58] Field of Search ..... 252/49.3, 49.5, 73, 252/79; 72/42

[56] References Cited

U.S. PATENT DOCUMENTS 3,833,502 9/1974 Leary et al. ..... 252/49.3

4,248,685 2/1981 Beede et al. ..... 526/112

4,257,902 3/1981 Singer ..... 252/18

*Primary Examiner*—Jacqueline V. Howard

[57] ABSTRACT

Substantially oil-free aqueous industrial fluids possess superior lubricating and wear preventing characteristics and are useful as hydraulic fluids and metalworking compositions. Fluids of the invention comprise (1) an aqueous liquid and (2) a water-soluble synthetic addition copolymer of (a) an ethylenically unsaturated crosslinking monomer, (b) an ethylenically unsaturated water-soluble monomer, and (c) an ethylenically unsaturated water-insoluble monomer.

The industrial fluids exhibit good Newtonian behavior and mechanical stability at high shear.

21 Claims, No Drawings

WATER-BASED HYDRAULIC FLUIDS

BACKGROUND OF THE INVENTION

This invention relates to water-based hydraulic and metalworking fluids, in particular those fluids which are thickened with a substantially water-swellable copolymeric thickening agent.

Petroleum oils have traditionally been used as hydraulic fluids. Such oils exhibit good Newtonian viscosity behavior. A Newtonian fluid is a fluid that possesses a viscosity which is independent of the velocity gradient. Thus, the shear stress ($\tau$) is related to the shear rate ($\gamma$) by the equation:

$$\tau = \eta\gamma$$

wherein $\eta$ is the shear rate independent viscosity. Further, petroleum oils have a viscosity that is fairly constant throughout the lifetime of the fluid at prolonged high shear rates. This mechanical stability to shear degradation is a desired property of hydraulic fluids. The shear stable Newtonian viscosity of a typical hydraulic oil is generally in the range of 10 to 100 centistokes at 100° F.

Water-based lubricant products are gaining popularity due to shortages of petroleum base supplies, environmental concerns caused by problems in disposing of oil-based wastes, cost incentives and fire safety considerations. Typically, a water-based hydraulic fluid consists of several water-soluble or emulsifiable additives such as corrosion inhibitors (alkanolamines), lubricity aids (long chain carboxylic acid salts) and/or extreme pressure additives (zinc dialkyldithiophosphates, phosphate esters, borates, etc.). However, such an additive package has a viscosity that is essentially equal to that of water. It is desirable to thicken such a water-based lubricant with a substantially water-swellable thickening agent to overcome the problems associated with the use of a low viscosity fluid.

Increased viscosity of the water-based hydraulic fluids is desirable for several reasons. In particular, thickened fluid can aid in the operation of system valves which have been designed to work specifically with oil-based fluids. Further, thickened fluids are less prone to experience leaking though small holes or cracks in the hydraulic system. Higher pump efficiencies are obtainable with thickened fluids, especially at high loads, and such fluids exhibit wear prevention characteristics in both hydrodynamic and elastohydrodynamic wear modes. It is desirable to provide a viscosity which is relatively constant throughout the lifetime of the fluid and relatively constant at varying shear rates. Shear rates in hydraulic vane pumps are estimated to be as high as one million reciprocal seconds.

For water-based hydraulic fluids, a polymer solution having a mechanically stable viscosity of about 10 to about 100 centistokes at 100° F. and a viscosity independent of shear rate at shear rates approaching up to about $10^6$ sec$^{-1}$ is desirable. One way of describing the viscosity dependence on shear rate is through the use of the Power Law:

$$\ln \tau = N \ln \gamma + \ln K.$$

Here, the shear stress ($\tau$) is found to vary in a nonlinear manner with shear rate ($\gamma$). Thus, the viscosity changes with changes in shear rate. N is a measure of the extent of deviations from Newtonian behavior. A Power Law N value of 1.0 indicates a Newtonian fluid. Anything less than 1.0 is said to be shear-thinning. The K value relates to the fluid viscosity at a shear rate of 1 sec$^{-1}$. Further, for the sake of economic efficiency, it is desirable to keep the polymer concentration as low as possible. However, it is not always possible to provide a polymer system that exhibits a desired, mechanically stable hydrodynamic size and the desired Newtonian viscosity while maintaining a high polymer thickening efficiency.

Water-soluble polymers can be made in a variety of physical structures and molecular weights. High molecular weight linear polymers are highly efficient thickeners. However, such polymers exhibit non-Newtonian viscosity behavior and suffer from mechanical degradation at high shear rates. Reduction in molecular weight of the linear polymers increases the Newtonian character and mechanical stability of the thickener. Unfortunately, such low molecular weight polymers require high concentrations to thicken the fluid and thus are not economical.

It is desirable to produce compositions which, at low concentrations, exhibit a substantial thickening effect on the water in the aqueous hydraulic systems formed thereby, and provide the aqueous system with high viscosity and enhanced shear stability. It is also desirable that the viscosities in the aqueous hydraulic fluid systems employing the thickeners approach the viscosities of oil-based hydraulic systems, i.e., about 10 to about 100 centistokes at 100° F.

SUMMARY OF THE INVENTION

This invention is a substantially oil-free hydraulic fluid or metalworking composition which maintains a Newtonian shear stable viscosity comprising an aqueous liquid and a functionally effective amount of a substantially water-swellable synthetic addition copolymer comprising the copolymerization product of at least one ethylenically unsaturated water-soluble monomer, at least one ethylenically unsaturated water-insoluble monomer, and at least one polyvinyl crosslinking monomer. Said synthetic addition copolymer comprises the copolymerization product of an amount of water-soluble monomer sufficient to provide swellability to the resulting copolymerization product, an amount of water-insoluble monomer sufficient to control the degree of swellability of the resulting copolymerization product, and an amount of crosslinking monomer sufficient to control the degree of swellability of the resulting copolymerization product while imparting mechanical reinforcement to said copolymerization product. As used herein, the term "aqueous liquid" means water or an aqueous solution comprising additives commonly employed in aqueous hydraulic fluids, such as corrosion inhibitors, anti-wear agents, etc. The compositions of matter of the present invention are thickened aqueous solutions which are pH responsive.

The hydraulic fluids and metalworking compositions of the present invention exhibit excellent lubricity and anti-wear characteristics, and are useful as coolants and lubricants of surfaces which are in frictional contact such as during operations of turning, cutting, peeling, grinding metals and the like. Such fluids and compositions are easily prepared, exhibit the desirable viscosities of oil-based hydraulic systems and maintain a relatively constant viscosity (i.e., provide a Newtonian shear stable viscosity) at high shear. As used herein, "high shear" means a shear rate of greater than about 1000 $sec^{-1}$. The hydraulic fluids and metalworking compositions are ecologically superior to those fluids and metalworking emulsions of the prior art containing petroleum oils, mineral oils or glycerol/water mixtures.

DETAILED DESCRIPTION OF THE INVENTION

Ethylenically unsaturated water-soluble monomers suitable for use in this invention are those which are sufficiently water-soluble to form at least about 5 weight percent solutions when dissolved in water and which readily undergo addition polymerization to form polymers which are at least inherently water-dispersible and preferably water-soluble. By "inherently water-dispersible" is meant that the polymer, when contacted with an aqueous medium, will disperse therein without the aid of surfactants to form a colloidal dispersion of the polymer in the aqueous medium. Said water-soluble monomers may be cationic, anionic or nonionic, with anionic and nonionic being most preferred. Such water-soluble monomers include acrylic acid, methacrylic acid, ethacrylic acid, crotonic acid, 2-chloracrylic acid, 2-bromoacrylic acid, 3-chloroacrylic acid, 2-phenolacrylic acid, 3-phenolacrylic acid, vinylbenzoic acid, isopropenolbenzoic acid, and the like; sodium styrene sulfonate; sulfoethyl methacrylate; acrylamide, methacrylamide and the like; hydroxy-containing esters of $\alpha,\beta$-ethylenically unsaturated, aliphatic monocarboxylic acids such as $\beta$-hydroxypropyl methacrylate, 4-hydroxybutyl acrylate, 5-hydroxypentyl methacrylate, hydroxyethyl acrylate, hydroxypropyl acrylate, and the like; dicarboxylic acids or their anhydrides such as maleic anhydride, itaconic anhydride, citraconic anhydride, chloromaleic anhydride, fumaric acid, maleic acid, itaconic acid and the like or the half esters or half amides of said acids; ethylenimines and amino acrylates such as dimethylaminoethyl methacrylate; and acrylamido-2-methylpropane sulfonic acid. Ethylenically unsaturated quaternary ammonium compounds such as vinylbenzyltrimethylammonium chloride, N-trimethylammoniumpropyl methacrylamide chloride and trimethylammoniumethyl acrylamide chloride can also be employed. Monomers such as vinyl acetate may be used since the polymers may be hydrolyzed to produce the alcohol group. It is most preferable that the monomer be potentially water-soluble upon an increase in pH of the aqueous solution (i.e., greater than about 7). Of course, it is understood that in the case of a nonionic monomer; a strong electrolyte monomer, such as sodium styrene sulfonate, an anionic strong electrolyte; or vinylbenzyltrimethyl ammonium chloride, a cationic strong electrolyte, the water solubility is essentially pH independent. It is also understood that in the case of a cationic monomer, which is much less preferred, the water solubility of said monomer will increase with a decrease in pH.

Of the aforementioned water-soluble monomers, the acid monomers such as acrylic acid and methacrylic acid are most preferred. Such monomers most readily introduce an alkali swellable characteristic to the resulting copolymer due to the hydrophilicity provided by such a species at a pH of from about 5 to about 14, most preferably from about 7 to about 12. The water swellability provided to the copolymer of this invention by said water-soluble monomers acts to increase the thickening efficiency of said copolymer.

Ethylenically unsaturated water-insoluble monomers suitable for use in this invention are those which are sufficiently water-insoluble to introduce substantial hydrophobicity in the resulting copolymer. Copolymerization products of this invention require substantial hydrophobic character in order that the degree of swellability be controlled and, hence, said copolymer will not undergo substantial changes in its hydrodynamic volume during a change in shear rate. These monomers are well known in the art and, hence, are illustrated below only by representative examples. The nonionic ethylenically unsaturated monomers are represented by, but not restricted to, hydrocarbon monomers such as the styrene compounds, such as styrene, $\alpha$-methylstyrene, ar-methylstyrene, ar-ethylstyrene, $\alpha$,ar-dimethylstyrene, ar,ar-dimethylstyrene and t-butylstyrene; the hydrocarbon monomers which are modified to possess nonionic substituents, such as hydroxystyrene, methoxystyrene and cyanostyrene; the unsaturated alcohol esters such as vinyl acetate and vinyl propionate; the unsaturated olefins, such as ethylene; the unsaturated ketones, such as vinyl methyl ketone and methyl isopropenyl ketone; the unsaturated ethers, such as vinylethyl ether and vinyl methyl ether; and the nonionic derivatives of ethylenically unsaturated carboxylic acids such as acrylic esters which include methyl acrylate, ethyl acrylate, butyl acrylate, hexyl acrylate, 2-ethylhexyl acrylate and lauryl acrylate; methacrylic esters, such as methyl methacrylate, ethyl methacrylate; the maleic esters such as dimethyl maleate, diethyl maleate and dibutyl maleate; the fumaric esters, such as dimethyl fumarate, diethyl fumarate and dibutyl fumarate and the itaconic esters, such as dimethyl itaconate, diethyl itaconate and dibutyl itaconate; the nitriles, such as acrylonitrile and methacrylonitrile; and species such as cyclopentadiene acrylate. While not in the preferred class, nonionic monomers containing halogens which are not activated may be employed, such as monochlorostyrene, dichlorostyrene, vinyl fluoride, chloroprene, vinyl chloride, vinylidene chloride and the like.

The polyvinyl crosslinking monomers are copolymerized with the aforementioned ethylenically unsaturated water-soluble and water-insoluble comonomers including, for example, divinyl benzene, acryloyl or methacrylyl polyesters of polyhydroxylated compounds, divinyl esters of polycarboxylic acid, diallyl esters of polycarboxylic acids, diallyl dimethyl ammonium chloride, triallyl terephthalate, N,N'-methylene diacrylamide, diallyl maleate, diallyl fumarate, hexamethylene bis maleimide, triallyl phosphate, trivinyl trimellitate, divinyl adipate, glyceryl trimethacrylate, diallyl succinate, divinyl ether, the divinyl ethers of ethylene glycol or diethylene glycol diacrylate, polyethylene glycol diacrylates or methacrylates, 1,6-hexanediol diacrylate, pentaerythritol triacrylate or tetracrylate, neopentyl glycol diacrylate, cyclopentadiene diacrylate, the butylene glycol diacrylates or dimethyacrylates, trimethylolpropane di- or tri-acrylates, and the like. Of the aforementioned polyvinyl crosslinking monomers, those most preferred include allyl acrylate, allyl methacrylate, crotyl acrylate and crotyl methacrylate.

The crosslinking monomer is present in the copolymerization product in amounts sufficient to control the degree of swellability of said copolymerization product while imparting mechanical reinforcement to said copolymerization product. That is, the crosslinked structure so formed does not readily deform in a flow field to the extent that a random coil (i.e., linear polymer) does. In such a way the Newtonian character of the copolymerization product is maximized. The structural reinforcements provided to the copolymerization product by the crosslinking also serves to minimize the effect that mechanical degradation has on reducing hydrodynamic size. That is, it is necessary to break several backbone links of the copolymerization product of this invention before any substantial change in hydrodynamic volume is observed. Conversely, one scission in the backbone of a linear polymer is enough to cause a substantial reduction in the hydrodynamic volume of said polymer. However, by limiting the degree of swellability of the copolymerization product, the low shear rate viscosity of the copolymer thickener is minimized. This decreases the thickening efficiency of the copolymer.

Conventional chain transfer agents can also be employed in the practice of preparing the copolymers of this invention and, indeed, in the polymerization stages it is desirable to do so. Examples of conventional chain transfer agents include bromoform, bromotrichloromethane, carbon tetrachloride and other alkyl halides; long chain mercaptans such as lauryl mercaptan, octyl mercaptan, tetradecyl mercaptan, hexadecyl mercaptan, dodecyl mercaptan and other such alkyl mercaptans; alkyl disulfides; 1,4,5,8-tetrahydronaphthalene; terpinolene; thioglycolic esters such as iso-octyl thioglycolate (IOTG), butyl thioglycolate and dodecyl thioglycolate; $\alpha$-methylstyrene dimer and alcohols such as ispropanol. Any conventional chain transfer agent can be used in regulating the molecular weight of the polymer formed herein and, typically, when such chain transfer agents are used, they are employed in amounts ranging from 0.10 to about 10.0 weight percent based on the weight of the monomers used in the polymerization steps herein.

Suitable emulsifying agents which can be employed in the copolymerization process include cationic, anionic or nonionic emulsifiers or detergents customarily used in emulsion polymerization. Preferably, at least one anionic emulsifier is included and one or more nonionic emulsifiers may also be present. Representative types of emulsifiers are the alkyl aryl sulfonates, alkali metal alkyl sulfates, the sulfonated alkyl esters, salts of high molecular weight fatty acids, amine soaps, alkali metal salts of rosin acids, ethylene oxide condensates of long chain fatty acids, alcohols or mercaptans. An example of a useful combination of emulsifiers is a tridecanolethyleneoxide condensate and an alkali metal salt of an aralkyl polyester sulfate. Specific examples of anionic emulsifiers known in the art include sodium dodecylbenzenesulfonate, sodium di(s-butyl)naphthalene sulfonate, sodium lauryl sulfate, disodium dodecyldiphenyl ether disulfonate, disodium n-octadecylsulfosuccinamate and sodium dioctylsulfosuccinate. A variety of nonionic surfactants and methods of their preparation are fully disclosed in "Nonionic Surfactants," Vol. 1, edited by M. J. Schick, published by Marcel Decker, Inc., New York, 1967. Suitable cationic surfactants include the classes of salts of aliphatic amines, especially the fatty amines, quaternary ammonium salts and hydrates, fatty chain derivatives of pyridinium compounds, ethylene oxide condensation products of fatty amines, sulfonium compounds, isothorium compounds and phosphonium compounds. Specific examples include dodecylamine acetate, tetradecylamine, hydrochloride, octadecylamine sulfate, cetyl pyridinium chloride, oleyl imidazoline and cetyl dimethyl benzyl ammonium chloride. Other representative emulsifiers and detergents are disclosed in "McCutcheon's Detergents and Emulsifiers," North American Edition, published by McCutcheon Division, MC Publishing Co., Glen Rock, N.J., 1980.

While much less preferred, a suspension stabilizer may also be employed to ensure that the polymerization of the monomers takes place under suspension polymerization conditions. Examples of representative suspension stabilizing agents include polyvinyl alcohol, polymerization products of acrylic acid and methacrylic acid, polyvinyl pyrrolidone, polyvinyl ether, maleic anhydride copolymers, salts of styrene-maleic anhydride copolymers, gelatins, cellulose ethers and sorbitol. Suitable inorganic suspension stabilizers include sparingly soluble metal phosphates such as hydroxy apatite. These materials are well known in the art and are utilized in varying proportions depending upon the desired viscosity and efficiency of the thickening or viscosity increasing effect.

The free-radical producing initiators conveniently employed are peroxygen compounds, especially inorganic persulfate compounds such as ammonium persulfate, potassium persulfate and sodium persulfate; peroxides such as hydrogen peroxide; organic hydroperoxides, such as cumene hydroperoxide, t-butyl hydroperoxide, acetyl peroxide, lauroyl peroxide; peracetic acid and perbenzoic acid (sometimes activated by a water-soluble reducing agent such as a ferrous compound or sodium bisulfite); as well as other free-radical producing materials such as 2,2'-azobisisobutyronitrile.

Other ingredients well known in the art may be included for various specific purposes. Such additives include buffering agents, inorganic salts and pH adjusting agents. Preferably, chelating reagents are added to remove ferric and other free metal ions, as well as calcium and magnesium ions which interfere with polymerization processes.

The copolymerization may be carried out batchwise, stepwise or continuously with batch and/or continuous addition of monomers and/or reagents in a conventional manner. Most preferably, the polymerization reaction is carried out by the addition of the monomer mix to an aqueous phase which has been preheated to between about 60° C. and about 90° C. and is under agitation. Addition rates may vary and may range from about ½ hour to about 10 hours, with 1 to 6 hours being most preferred. The system is allowed to react for about 1 to about 10 hours before cooling.

The copolymer thickeners are prepared by reacting the previously described monomers and reagents using conventional polymerization techniques. For example, copolymers may be prepared from reacting the aforementioned water-soluble monomers using aqueous solution polymerization techniques. Another well known and well documented method includes suspension polymerization using the aforementioned suspending agents. Additionally, the inverse emulsion polymerization process may be employed. Such water-in-oil emulsion polymerization procedures are taught in Vanderhoff et al., U.S. Pat. No. 3,284,393. The preferred method of preparation involves emulsion polymerizing the monomers at a pH of about 1.0 to about 5.0, preferably about 3.0 using free-radical producing initiators, usually in an amount from about 0.01 to about 3 parts based on 100 parts monomers.

The emulsion polymerization of the crosslinking containing monomers, the water-soluble monomers and the water-insoluble monomers is optimally carried out under inert atmosphere (i.e., nitrogen) using about 100 to about 1000 parts of a deionized or distilled water solvent preferably treated with a small amount (i.e., less than about 0.01 part based on 100 parts monomers) of chelating agents. Most advantageously, a monomer mix containing 100 parts monomer, about 0 to about 10 parts of chain transfer agent, and 0 to about 10 parts surfactant (preferably nonionic) is added to the aqueous charge. After the reaction is completed and the mixture has cooled, 0 to about 10 parts of a neutralant such as sodium hydroxide, aqueous ammonia or monoisopropanolamine may be added along with stabilizers such as chelating reagents or formaldehyde. Coagulum is removed from the latex/aqueous mixture by filtration using, for example, a 200 mesh screen. Such latex particles are typically in the range of about 200 Å to about 3000 Å in size as determined by disymmetry measurement techniques.

In the practice of preparing the copolymer latex, it is desirable to copolymerize from about 0.01 to about 10, preferably from about 0.01 to about 2, most preferably about 0.1 to about 1, weight percent crosslinking monomer, from about 5 to about 95, preferably from about 10 to about 60, most preferably from about 20 to about 55, weight percent water-soluble monomer, and from about 5 to about 95, preferably from about 40 to about 90, most preferably from about 45 to about 80, weight percent water-insoluble monomer. It is understood that the amount of the crosslinking monomr which is employed in preparing the copolymerization product of this invention is dependent upon the crosslinking efficiency of the crosslinking monomer which is employed. It is also understood that crosslinking monomers having low crosslinking efficiency are more likely to precipitate out of solution, and are more difficult to handle.

The most preferred copolymer thickeners are prepared from water-insoluble monomers that, if homopolymerized, would yield a polymer having a low glass transition temperature ($T_g$) (i.e., a $T_g$ of less than about 25° C.). Such monomers will be referred to as "soft" monomers, as opposed to "hard" monomers which, if homopolymerized would yield polymers having $T_g$s greater than about 25° C. It is desirable that the resulting latex particle not have an exceedingly high hydrophobic character in order that the latex particle be swellable and, hence, perform well as a thickener. However, it is also necessary that the latex particles exhibit a sufficiently high hydrophobicity in order that the copolymer particles maintain their integrity (i.e., a definite particle character) after swelling has occurred. For example, the desired latex properties can be obtained by increasing the relative amount of the crosslinking monomer and decreasing the relative amount of "hard" monomer which is present in the copolymer. Similarly, desired latex properties can be obtained by decreasing the relative amount of the crosslinking monomer and increasing the relative amount of "hard" monomer which is present in the copolymer.

High viscosity copolymer thickeners can be obtained by copolymerizing relatively large amounts of "soft" monomer with the water-soluble monomers and crosslinking monomers. In addition, an increase in the amount of the crosslinking monomer relative to the other monomers will increase the molecular weight of the copolymer and, hence, the viscosity of the copolymer, when small amounts of crosslinking monomer are employed. It is understood, however, that a relatively large amount of crosslinking monomer will ultimately act to reduce the viscosity exhibited by the copolymer particle.

It is understood that a copolymer can be prepared comprising at least one water-soluble monomer, at least one "hard" monomer, and no crosslinking monomer. Such a copolymer exhibits sufficient hydrophobicity in order that particles so formed maintain their integrity (i.e., definite particle character) after swelling.

It is also understood that crosslinking to the extent desired may also be provided from a crosslinking impurity in one or more of the comonomers, or from a side reaction of one or more of the comonomers yielding a water-swellable rather than a water-soluble product, even though no crosslinking monomer is present in the monomer mix.

It is also understood that a sufficient amount of crosslinking under certain circumstances can sufficiently control the degree of swellability of the copolymer. Under such circumstances, it is understood that another aspect of the present invention is a substantially oil-free hydraulic fluid or metalworking composition which maintains a Newtonian and shear stable viscosity comprising an aqueous liquid and a substantially water-swellable synthetic addition copolymer comprising the reaction product of at least one water-soluble ethylenically unsaturated monomer in an amount sufficient to provide swellability to said copolymer, and at least one polyvinyl crosslinking monomer in an amount sufficient to control the degree of swellability of said copolymer while imparting mechanical reinforcement to said copolymer.

The copolymer thickener prepared as hereindescribed is pH responsive, wherein the term "pH responsive" means that the hydrophilicity of the copolymer varies with pH. For example, the anionic copolymer is substantially less hydrophilic in an aqueous liquid having a pH of less than about 5 than in a neutral or alkaline aqueous liquid. The ability of the copolymer to thicken the composition is a result of the aforementioned change in hydrophilicity wherein the copolymer is insoluble (i.e., hydrophobic) in an aqueous liquid at one pH, thereby having little or no effect on the viscosity or other properties of the aqueous liquid. At a second pH, the copolymer dissolves or swells sufficiently in the aqueous liquid to increase the viscosity of the liquid. Advantageously, the anionic copolymer thickeners are essentially insoluble (i.e., preferably forming no more than about a 0.5 weight percent solution) in an aqueous liquid having a pH of less than about 5. Such copolymer thickeners become highly viscous at a pH in the range of about 5 to about 7. Alternatively, in a neutral or alkaline aqueous liquid, the copolymer dissolves or swells extensively in said aqueous liquid. The copolymer dissolves or swells sufficiently in an aqueous liquid having a pH of at least about 7, preferably about 7 to about 12. The copolymer solution is most preferably employed at a pH in the range of from about 8.5 to about 10.

In the form of a stable, aqueous colloidal dispersion at an acid pH of about 3 to about 6, the copolymer is particularly useful. Such an aqueous dispersion may contain about 10 to about 50 weight percent of polymer solids, yet be of relatively low viscosity. Thus, it is readily metered and blended with aqueous product systems. However, the dispersion is pH responsive. When the pH of the polymer dispersion is adjusted by addition of a base such as ammonia, an amine or a nonvolatile inorganic base such as sodium hydroxide, potassium carbonate or the like, the aqueous mixture becomes translucent or transparent as the polymer swells at least partially in the aqueous phase with a concurrent increase in viscosity. This neutralization can occur in situ when the liquid emulsion polymer is blended with an aqueous solution containing a suitable base. If desired for a given application, pH adjustment by partial or complete neutralization can be carried out before or after blending the liquid emulsion polymer with an aqueous product.

The particle size of the copolymer (i.e., latex) particles so formed and used herein ranges from less than about 200 Å to about 3000 Å in diameter. The particle size of the latex particles depends upon the method used to prepare said particles and the amount of surfactant that is employed during the preparation of said latex. In particular, the use of smaller amounts of surfactant will yield larger size latexes. Most preferred are those particles of a size in the range of from about 200 Å to about 900 Å. Most preferred are those particles which are small in size in that such particles when employed in preparing the formulations of this invention, yield fluids of highly Newtonian character. It is understood, however, that such smaller size particles, though providing a good Newtonian behavior to said fluids are less efficient thickeners, and thus require a relatively high amount of thickener in the aqueous liquid to obtain the desired viscosity.

The copolymers which are prepared by the aforementioned polymerization techniques are useful as thickeners and can have viscosities as high as about 1500 centipoises as measured using a standard Brookfield viscometer as a 1 percent aqueous solution at a pH of about 9.5 and at about 25° C. However, high viscosity thickeners are extremely pseudoplastic and exhibit extremely poor Newtonian behavior. The preferred copolymers of this invention exhibit viscosities of less than about 600 centipoises, most preferably less than about 200 centipoises, as measured using a standard Brookfield viscometer at a 5 percent aqueous solution at a pH of about 9.5 and at about 25° C. Such copolymers exhibit extremely good Newtonian behavior.

The copolymer thickeners of the present invention are capable of thickening an aqueous liquid to provide the resulting fluid with a viscosity comparable to that of oil-based hydraulic fluids. By the term "thicken" is meant that the viscosity of the liquid is measurably increased upon the addition of the copolymer thickener thereto, when said viscosities are measured using conventional techniques such as with a Brookfield viscometer. The specific amount of copolymer present as a thickener in aqueous media will depend on a variety of factors including the end use application and the amount and composition of thickener employed.

The copolymer thickeners of the present invention are broadly characterized as crosslinked, swellable latexes. Such latexes have high thickening ability at low concentrations in an aqueous liquid, and maintain their good thickening ability even after prolonged service at high rates of shear. The good shear stability makes the latexes more suitable than either high or low molecular weight linear polymers which are used as thickeners in hydraulic fluid or metalworking applications.

The crosslinked latex provides a viscosity to the aqueous liquids which is less dependent on shear rate changes than other typical thickeners (i.e., the crosslinked latex thickeners are more Newtonian in nature). The crosslinked latex also exhibits a viscosity that is highly constant throughout the lifetime of the fluid (i.e., is mechanically stable to shear degradation). Furthermore, the alkali-swellable (i.e., pH responsive) latexes which are manageable when at a low pH, can be mixed with an aqueous liquid and can be neutralized with a base to yield a good thickener.

The hydraulic fluids and metalworking compositions of the invention comprise a functionally effective amount of a copolymer thickener formulated with an aqueous liquid to give the desired balance of properties for the desired application. Said fluids and compositions generally comprise from about 85 percent to about 99.9 weight percent aqueous liquid and from about 0.1 percent to about 15 weight percent copolymeric thickener. These aqueous liquids comprise water and additives such as other thickening agents, defoamers, corrosion inhibitors and metal deactivators or chelating agents. Preferably, said formulations comprise about 0.5 to about 10 weight percent copolymer thickener and about 90 to about 99.5 percent aqueous liquid. The fluids are easily formulated at room temperature using distilled or deionized water although tap water can also be used without adverse effects on the fluid properties.

Additives common to hydraulic or metalworking fluids may be added to the thickened compositions without hindering the desired properties of the hydraulic fluid or metalworking composition. For example, small amounts of corrosion inhibitors such as alkali metal nitrites, nitrates, phosphates, silicates and benzoates may be added as liquid-vapor phase corrosion inhibitors. Representative suitable organic inhibitors include hydrocarbyl amine and hydroxy-substituted hydrocarbyl amine neutralized acid compound, such as neutralized phosphates and hydrocarbyl phosphate esters, neutralized fatty acids (e.g., those having 8 to about 22 carbon atoms), neutralized aromatic carboxylic acids (e.g., 4-(t-butyl)benzoic acid), neutralized naphthenic acids and neutralized hydrocarbyl sulfonates. Mixed salt esters of alkylated succinimides are also useful. Particularly useful amines includes the alkanolamines such as ethanolamine, diethanolamine, triethanolamine and the corresponding propanolamines. Other amine-type corrosion inhibitors are morpholine, ethylenediamine, N,N-diethylethanolamine, alpha- and gamma-picoline, piperazine and isopropylaminoethanol. Other additives include colorants; dyes; deodorants such as citronella; bacteriacides and other antimicrobials; water softeners such as an ethylene diamino tetraacetate sodium salt or nitrilo triacetic acid; antifreeze agents such as ethylene glycol and analogous polyoxyalkylene polyols; anti-foamants such as silicone-containing agents and shear stabilizing agents such as commercially available polyoxyalkylene polyols. Antiwear agents, friction modifiers, anti-slip and lubricity agents may also be added. Such agents include metal or amine salts of an organo sulfur, phosphorus, boron or carboxylic acid which is the same as or of the type as used in oil-based fluids. Typical of such salts are carboxylic acids of 1 to 22 carbon atoms including both aromatic and aliphatic acids; sulfur acids such as alkyl and aromatic sulfonic acids and the like; phosphorus acids such as phosphoric acid, phosphorous acid, phosphinic acid, acid phosphate esters, and analogous sulfur homologs such as the thiophosphoric and dithiophosphoric acid and related acid esters; mercaptobenzothiozole; boron acids include boric acid, acid borates and the like. Useful functional additives also include lubricity aids such as metal dithiocarbamates including molybdenum and antimony dithiocarbamates; as well as dibutyltin sulfide, tributyltin oxide, phosphates and phosphites; borate amine salts, chlorinated waxes; trialkyltin oxide, molybdenum phosphates and chlorinated waxes. Extreme pressure additives include phosphate esters and zinc dialkyl dithiophosphate.

It should also be noted that many of the ingredients described above for use in making the substantially oil-free hydraulic fluids and metalworking compositions of this invention are industrial products which impart more than one property to the composition. Thus, a single ingredient can provide several functions thereby eliminating or reducing the need for some other additional ingredient. Thus, for example, a dispersing agent may also serve in part as an inhibitor of corrosion. Similarly, it may also serve as a neutralizing agent to adjust pH or as a buffer to maintain pH. Similarly, a lubricity agent such as tributyltin oxide can also function as a bactericide. In addition, lauric acid, when employed in small amounts as a lubricity aid, may also act as as a viscosity enhancing agent.

The hydraulic fluid and metalworking compositions of this invention, when formulated as taught above, are transparent or slightly turbid liquids having a viscosity of up to about 1500 centipoises at 100° F., which are stable over long periods of storage at ambient temperature. Most preferably, hydraulic fluids and metalworking compositions of this invention are formulated such that the viscosity is between about 10 and about 100 centipoises at 100° F. In addition, the hydraulic fluids and metalworking additives of the invention are substantially oil-free and will not support combustion in contrast to those flame-resistant fluids of the prior art based upon a glycol and water or petroleum oils. The hydraulic fluids and metalworking additives of the invention are ecologically clean and nonpolluting compositions when compared to existing petroleum-based hydraulic fluids. Since the hydraulic fluids and metalworking additives of the invention are largely based upon synthetic materials which are not derived from petroleum, the production of such fluids is relatively independent of shortages of petroleum oil and not materially influenced by the economic impact of such shortages.

The hydraulic fluids of the invention can be used in various applications requiring hydraulic pressures in the range of up to about 2,000 pounds per square inch since they have all the essential properties such as lubricity, viscosity and corrosion protection. The hydraulic fluids of the invention are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators and other machinery or for closing dies in die-casting machines and in injection molding equipment and other applications.

The hydraulic fluids and metalworking compositions of the present invention can be used in methods for shaping solid material with a work tool by lubricating the tool and/or the material. These shaping processes comprise cutting, grinding, drilling, punching, stamping, turning, lapping, polishing, rolling, drawing and combinations of said processes. Often the solid material is a metal work piece or it may be earth, rock, sand, concrete or a mixture of these. When the work piece is metal, it can comprise at least one ferrous or at least one nonferrous metal or a combination of both. When the material is earth, rock, sand, concrete, cement or a mixture of these, the tool is often a drill of rotary or precussion-type and the earth, rock, sand, concrete, cement or a mixture of same, overlies a naturally occuring deposit, such as a deposit of fossil fuel, an ore body, or an economically valuable mineral such as gem stones and the like.

The following examples are given to further illustrate the invention and should not be considered as limiting the scope thereof. All percentages are in weight percent unless otherwise noted.

EXAMPLE 1

A 500-ml capacity, round-bottom flask equipped with a pulse feeder pump for delivering monomer, an agitation means and a reflux condenser is charged with 195 g of deionized water. The charge is purged with nitrogen and preheated to 85° C. To the charge is added 50 mg of sodium persulfate and 2.5 g of a 29.8 percent sodium lauryl sulfate solution which is sold commercially under the trade name Equex SP by Proctor & Gamble, in 5 g of deionized water. A 50-g monomer mix is prepared and is continuously added to the aqueous charge while under nitrogen for a one-hour period. The monomer mix comprises 0.061 g of allyl methacrylate, 28.2 g of methacrylic acid and 21.8 g of ethylacrylate. The system is continuously stirred and maintained at about 85° C. for an additional hour in order to complete the reaction. The system is cooled to room temperature and filtered with a 200 mesh screen. The particle size of the latex particles so formed is 805 Å as determined by disymmetry measurements.

EXAMPLE 2

To a 500-ml capacity, round-bottom flask equipped as in the previous example is charged 150 ml of deionized water, 0.05 g of sodium persulfate, 5 g of monomer mixture, and an amount of Equex SP as indicated in Table I. The ingredients are mixed as described in the previous example. The monomer mix comprises 3 g of methacrylic acid, 2 g of ethylacrylate and 0.05 g of allyl methacrylate. The system is allowed to react as described in the previous example, cooled, filtered and the particle size of the latex particles is measured by disymmetry techniques.

Several of the latexes so prepared are added to deionized water to form a 1 percent latex formulation. Shear data is then collected for these solutions. Data illustrating the particle size of the various samples and Power Law N of selected formulations is presented in Table I.

TABLE I

| Sample | Amount of Surfactant[1] | Particle Size (Å) | Power Law N[2] |
|---|---|---|---|
| 1 | 0.05 | 2500 | — |
| 2 | 0.01 | 1870 | — |
| 3 | 0.25 | 1200 | 0.740 |
| 4 | 1 | 700 | — |
| 5 | 2 | 530 | 0.789 |
| 6 | 3 | 480 | — |
| 7 | 4 | 440 | — |
| 8 | 5 | 340 | 0.841 |
| 9 | 10 | <250 | — |

[1]The amount of surfactant is presented in weight percent based on the total monomer content.

[2]Power Law N is presented for data collected over a shear rate range of 86 $sec^{-1}$ to 2760 $sec^{-1}$ as measured using Haake NV system at 40° C.

The results presented in Table I indicate that a decrease in the amount of the surfactant employed in the preparation of the latex acts to increase particle size. In addition, the data indicates the more Newtonian character of a latex formulation comprising smaller sized particles.

EXAMPLE 3

Samples are prepared as taught in Example 1, except that the amount of allyl methacrylate is held constant at 0.4 percent. The amount of ethylacrylate and methacrylic acid is varied as indicated in Table II. The latexes so prepared are added to deionized water to form a 4 percent latex formulation. Viscosity and shear data concerning the respective formulations is presented in Table II. The pH of the formulation is about 10 for all viscosity measurements.

TABLE II

| Sample | Monomer Mix AMA[1] | EA[2] | MAA[3] | Viscosity[4] | Power Law N[5] |
|---|---|---|---|---|---|
| 1 | 0.4 | 79.6 | 20 | 16.6 | 0.982 |
| 2 | 0.4 | 69.6 | 30 | 23.8 | 0.936 |
| 3 | 0.4 | 59.6 | 40 | 39.5 | 0.879 |
| 4 | 0.4 | 49.6 | 50 | 114 | 0.758 |
| 5 | 0.4 | 39.6 | 60 | 163 | 0.756 |

[1]AMA is allyl methacrylate.
[2]EA is ethyl acrylate.
[3]MAA is methacrylic acid.
[4]Viscosity is presented in centipoises and is measured using a Haake NV system at 40° C. and at a low shear of 86 $sec^{-1}$.
[5]Power Law N is presented for data collected over a shear rate range of 86 $sec^{-1}$ as measured using a Haake NV system at 40° C.

The data indicates that a lowering of the acid content in the latex leads to decreasing thickening efficiency (i.e., the viscosity at low shear decreases). However, a decrease in the acid content leads to a more Newtonian (i.e., shear rate independent) viscosity.

EXAMPLE 4

Sample 1 of Example 3 is dialyzed to remove residual sodium lauryl sulfate using a semipermeable membrane and added to deionized water to form a 5.4 percent latex solution. The pH is adjusted to 9.5 with sodium hydroxide after 1 percent lauric acid and 500 ppm of Dow Corning Antifoam DB-110A are added to the solution. The solution is designated Sample S-1. The viscosity of the solution is measured under shear conditions as described in Example 3 to yield a Power Law N of 0.979. Wear tests of Sample S-1 are performed and compared to those values received for commercially available hydraulic fluids. Wear values are measured using a Falex simulated vane pump test on a Falex Model 6 Friction and Wear Tester.

TABLE III

| Sample | Wear (mg)[2] |
|---|---|
| S-1 | 9.1 |
| C-1[1] | 23.5 |
| C-2[1] | 18.7 |
| C-3[1] | 21.5 |

[1]Samples C-1, C-2 and C-3 are commercially available hydraulic fluids, are used for comparison purposes, and are not examples of this invention.
[2]Wear data is presented in milligram wear after samples are tested at 50° C. under 500 lbs. load, at 1000 rpm for 100 minutes.

The data indicates very low wear when Sample S-1 is used under hydraulic fluid conditions.

EXAMPLE 5

The degradation stability of selected samples is measured. This is a measure of the viscosity after the fluid has been subjected to shear in a Waring Blendor for about 30 minutes. The latexes are prepared as follows:

Sample 4 of Example 2 is added to deionized water to form a 1 percent latex formulation. The pH is adjusted to 10 with sodium hydroxide. The formulation is designated Sample S-2.

Sample 5 of Example 3 is added to deionized water to form a 2 percent latex formulation. The pH is adjusted to 10 with sodium hydroxide. The formulation is designated Sample S-3.

Sample 1 of Example 3 is added to deionized water to form a 4 percent latex formulation. The pH is adjusted to 10 with sodium hydroxide. The formulation is designated Sample S-4. The amount of viscosity which is lost for each of the samples is presented in Table V.

TABLE V

| Sample[1] | Percent Visc. Lost |
|---|---|
| S-2 | 14 |
| S-3 | 7 |
| S-4 | 1 |

[1]A shear of about $10^6$ $sec^{-1}$ is supplied for about 30 minutes prior to measurements using an Ostwald Tube viscometer.

The above data indicates that the fluids of this invention retain good viscosity after having been subjected to high shear. This good degradation stability of the samples of this invention indicates a highly Newtonian fluid which maintains its good properties over periods of repeated use. In contrast, a commercially available fluid tested under similar conditions loses 16 percent of its initial viscosity.

What is claimed is:

1. A substantially oil-free hydraulic fluid or metalworking composition which maintains an essentially Newtonian and shear stable viscosity comprising an aqueous liquid and a thickening amount of a substantially water-swellable synthetic addition copolymer comprising the reaction product of (1) at least one water-soluble ethylenically unsaturated monomer in an amount sufficient to provide swellability to said copolymer, (2) at least one water-insoluble ethylenically unsaturated monomer in an amount sufficient to control the degree of swellability of said copolymer, and (3) at least one crosslinking monomer in an amount sufficient to control the degree of swellability of said copolymer while imparting mechanical reinforcement to said copolymer; such that the viscosity of said composition approaches that of an oil-based hydraulic fluid or metalworking composition.

2. A hydraulic fluid or metalworking composition of claim 1 wherein said crosslinking monomer is a polyvinyl crosslinking monomer.

3. A hydraulic fluid or metalworking composition of claim 1 wherein at least one of said water-soluble monomers is anionic in character.

4. A hydraulic fluid or metalworking composition of claim 1 having a viscosity of about 10 to about 100 cps at 100° F.

5. A substantially oil-free hydraulic fluid or metalworking composition which maintains an essentially Newtonian and shear stable viscosity comprising an aqueous liquid and a thickening amount of a substantially water-swellable synthetic addition copolymer comprising the reaction product of (1) at least one water-soluble ethylenically unsaturated monomer in an amount sufficient to provide swellability to said copolymer and (2) at least one polyvinyl crosslinking monomer in an amount sufficient to control the degree of swellability of said copolymer while imparting mechanical reinforcement to said copolymer, such that the viscosity of said composition approaches that of an oil-based hydraulic fluid or metalworking composition.

6. A hydraulic fluid or metalworking composition of claim 5 wherein said water-soluble monomer is anionic in character.

7. A hydraulic fluid or metalworking composition of claim 5 having a viscosity of about 10 to about 100 cps at 100° F.

8. A hydraulic fluid or metalworking composition of claim 1 wherein said copolymer has a preswollen particle size ranging from about 200 Å to about 3000 Å.

9. A substantially oil-free hydraulic fluid or metalworking composition of claim 2 comprising about 85 to about 99.9 weight percent of an aqueous liquid and about 0.1 to about 15 weight percent of a water-swellable synthetic addition copolymer comprising (1) about 0.01 to about 10 weight percent of said polyvinyl crosslinking monomer, (2) about 5 to about 95 weight percent of said water-soluble ethylenically unsaturated monomer and (3) about 5 to about 95 weight percent of said ethylenically unsaturated water-insoluble monomer.

10. A substantially oil-free hydraulic fluid or metalworking composition of claim 2 comprising about 85 to about 99.9 weight percent of an aqueous liquid and about 0.1 to about 15 weight percent of a water-swellable synthetic addition copolymer consisting essentially of (1) about 0.01 to about 2 weight percent of said polyvinyl crosslinking monomer, (2) about 10 to about 60 weight percent of said water-soluble ethylenically unsaturated monomer and (3) about 40 to about 90 weight percent of said ethylenically unsaturated water-insoluble monomer.

11. A hydraulic fluid or metalworking composition of claim 10 comprising about 90 to about 99 weight percent aqueous liquid and about 1 to about 10 weight percent of said water-swellable synthetic addition copolymer.

12. A hydraulic fluid or metalworking composition of claim 10 comprising a water-soluble synthetic addition copolymer consisting essentially of (1) about 0.1 to about 1 weight percent polyvinyl crosslinking monomer, (2) about 10 to about 60 weight percent water-soluble ethylenically unsaturated monomer and (3) about 40 to about 90 weight percent ethylenically unsaturated water-insoluble monomer.

13. A hydraulic fluid or metalworking composition of claim 3 having a pH of at least about 7.

14. A hydraulic fluid or metalworking composition of claim 1 wherein said water-soluble monomer is a member selected from the group consisting of acrylic acid, methacrylic acid, acrylamide, maleic anhydride, methacrylamide and dimethyl aminoethyl methacrylate.

15. A hydraulic fluid or metalworking composition of claim 1 wherein said water-insoluble ethylenically unsaturated monomer is a member selected from the group consisting of styrene, α-methyl styrene, methylacrylate, butylacrylate, ethylacrylate, methylmethacrylate, ethylmethacrylate, acrylonitrile, methacrylonitrile, vinyl chloride and vinylidene chloride.

16. A hydraulic fluid or metalworking composition of claim 2 wherein said crosslinking monomer is a member selected from the group consisting of allyl acrylate, allyl methacrylate, crotyl acrylate and crotyl methacrylate.

17. A hydraulic fluid or metalworking composition of claim 1 wherein said synthetic addition copolymer comprises (1) about 0.1 weight percent allyl methacrylate, (2) about 79.6 weight percent ethylacrylate and (3) about 20 weight percent methacrylic acid.

18. A hydraulic fluid or metalworking composition of claim 1 wherein said aqueous liquid contains an antifoaming agent.

19. A hydraulic fluid or metalworking composition of claim 1 wherein said aqueous liquid contains a lubricity aid.

20. A hydraulic fluid or metalworking composition of claim 1 wherein said aqueous liquid contains a corrosion inhibitor.

21. A hydraulic fluid or metalworking composition of claim 1 wherein said aqueous liquid contains an extreme pressure additive.

* * * * *